US009803826B2

(12) United States Patent
Wu

(10) Patent No.: US 9,803,826 B2
(45) Date of Patent: Oct. 31, 2017

(54) METHOD FOR FOLDING FLAT, NON-RIGID MATERIALS TO CREATE RIGID, THREE-DIMENSIONAL STRUCTURES

(71) Applicant: Indiana University Research and Technology Corp., Indianapolis, IN (US)

(72) Inventor: Jiangmei Wu, Bloomington, IN (US)

(73) Assignee: Indiana University Research and Technology Corporation, Indianapolis, IN (US)

( * ) Notice: Subject to any disclaimer, the term of this patent is extended or adjusted under 35 U.S.C. 154(b) by 286 days.

(21) Appl. No.: 14/518,062

(22) Filed: Oct. 20, 2014

(65) Prior Publication Data

US 2015/0109799 A1 Apr. 23, 2015

Related U.S. Application Data

(60) Provisional application No. 61/893,519, filed on Oct. 21, 2013.

(51) Int. Cl.

| | |
|---|---|
| ***F21V 1/14*** | (2006.01) |
| ***F21V 1/26*** | (2006.01) |
| ***F21V 1/18*** | (2006.01) |

(52) U.S. Cl.

CPC ..... *F21V 1/146* (2013.01); *F21V 1/18* (2013.01); *F21V 1/26* (2013.01)

(58) Field of Classification Search

None

See application file for complete search history.

(56) References Cited

U.S. PATENT DOCUMENTS

| | | | | |
|---|---|---|---|---|
| 1,940,672 | A * | 12/1933 | Angeletti | F21V 1/26 362/351 |
| 2,404,162 | A * | 7/1946 | Brown | F21V 1/26 362/354 |
| 3,407,558 | A | 10/1968 | Resch | |
| 2007/0165195 | A1* | 7/2007 | Lockett | F21V 1/00 353/120 |
| 2009/0196052 | A1* | 8/2009 | Fremont | B44C 5/00 362/352 |

OTHER PUBLICATIONS

Nishiyama, Yutaka (2012), "Miura folding: Applying origami to space exploration", International Journal of Pure and Applied Mathematics, 79 (2): 269-279.

* cited by examiner

*Primary Examiner* — Sharon Payne

(74) *Attorney, Agent, or Firm* — Faegre Baker Daniels LLP

(57) ABSTRACT

The present disclosure provides a cover for a light source and a method for making a cover for a light source.

19 Claims, 18 Drawing Sheets

METHOD FOR FOLDING FLAT, NON-RIGID MATERIALS TO CREATE RIGID, THREE-DIMENSIONAL STRUCTURES

PRIORITY CLAIM

The present application claims priority to U.S. Provisional Patent App. No. 61/893,519, filed Oct. 21, 2013, the entire disclosure of which is hereby expressly incorporated herein by reference.

FIELD

The present disclosure relates generally to creating rigid three-dimensional structures by folding flat, non-rigid materials. More particularly, the present disclosure relates to a method of folding a non-rigid material with a score or crease pattern into a three-dimensional structure for covering a light source.

BACKGROUND AND SUMMARY

A variety of covers and shades exist for use with different light sources. A cover for a light source with a flame, such as an oil lamp, may be made from glass. A cover for a light bulb may be made from cloth, or a similar non-rigid material, which is then made rigid by a metal frame.

The need for light source coverings to rest a distance away from one or more light sources and be stable has required the use of rigid materials or rigid supports with light source coverings. However, this limits the design and aesthetic qualities for light source coverings. In the typical situation, a covering for a light source is made from a rigid material such as glass or plastic, or is made from a non-rigid material such as cloth, and is supported by a frame made from a rigid material, such as metal. Rigid materials such as glass and plastic cannot be easily manipulated like a non-rigid material such as cloth, yet cloth and similar materials cannot provide support without a frame.

Although paper folding has been around for hundreds of years, the advance of digital techniques in recent years has allowed artists, mathematicians and computer engineers to develop complex paper objects that can be folded from hundreds of creases. These creases in paper, or a similar non-rigid material, increase the rigidity of the material. A flat piece of paper doesn't exhibit stiffness, but once paper and similar materials are folded in the manner of the present disclosure, the rigidity and stiffness of the material increase significantly.

In the present disclosure, score lines or crease lines are imprinted or marked on a non-rigid material while it lies substantially flat. In one exemplary embodiment, a non-rigid material is one or more flat pieces of paper, cardboard, or Tyvek. The score lines create patterns or grids on the flat, non-rigid material. The grids allow the paper or similar non-rigid material to be orderly folded with mountain and valley folds. Once folded according to the grids, the non-rigid material behaves in a structurally sound manner. A rigid, three-dimensional shape is formed after folding, and may be used as a cover or shade for a light source.

Various digital programs and digital tools can be used to create score line patterns and mark the score lines onto a non-rigid material, such as paper. These digital pattern design programs include, but are not limited to, those programs such as AutoCAD and Adobe Illustrator. Digital machines can be used to imprint or mark the score patterns or grids onto the non-rigid material without cutting the material. Such machines include, but are not limited to, Graphtec vinyl cutters. Pieces of paper or similarly non-rigid material can be shaped into three-dimensional spatial forms that are structurally cohesive when folded according to particular two-dimensional crease patterns. Mechanical properties such as rigidity or stiffness are altered by adding folded textures to a non-rigid material's surface.

Once the paper or similar non-rigid material is folded into a three-dimensional shape, it may be used as a lamp shade. Though, such a structurally sound three-dimensional object might be used for other purposes, such as, for example, as containers or buildings, at larger or smaller scales. Furthermore, materials of different rigidity may be used depending on the intended final use of the folded object.

In some exemplary embodiments, the present disclosure provides a structure for covering a light source folded from one piece of paper, or one piece of similarly non-rigid material. Paper, as a material, is chosen because it can be easily manipulated using simple tools such as scissors and knives. In such an embodiment, the material can be folded flat for shipping and storage, and can then be deployed into three-dimensional forms. These designs therefore are flat-foldable. In some embodiments, the coverings for a light source are folded from multiple pieces of paper by using modular Origami, or paper folding, techniques. In other embodiments, the cover for a light source may be of a complex design. Such a complex design may be made with a digital program. Once designed, the grids or patterns are scored or marked onto a non-rigid material using a digital machine, such as a digital cutter. In some embodiments, the cover for a light source may be of a simple design and easily reproducible.

In other embodiments, cotton paper or recyclable synthetic material able to be marked and folded, such as Tyvek paper, is used to make a three-dimensional covering for a light source wherein the light source is a LED (light-emitting diode) light or lights. Tyvek, as one example of synthetic material, comprises flashspun high-density polyethylene fibers. The material is very strong, and it is difficult to tear, but can be cut easily with scissors or a knife. Water vapor can pass through Tyvek, but liquid water cannot.

The present disclosure thus provides a cover for a light source comprising a non-rigid material with a plurality of mountain and valley folds, wherein said folds create a rigid three-dimensional shape capable of covering a light source.

Another embodiment provides a cover for a light source comprising a non-rigid material with a plurality of mountain and valley folds, wherein: (1) said folds create a rigid three-dimensional shape capable of covering a light source and (2) the rigid three-dimensional shape comprises a single piece of non-rigid material.

Still another embodiment provides a cover for a light source comprising a non-rigid material with a plurality of mountain and valley folds, wherein: (1) said folds create a rigid three-dimensional shape capable of covering a light source and (2) the non-rigid material is selected from the group consisting of paper, cardboard, synthetic material, and cotton paper.

Still another embodiment provides a cover for a light source comprising a non-rigid material with a plurality of mountain and valley folds, wherein: (1) said folds create a rigid three-dimensional shape capable of covering a light source and (2) the non-rigid material has digitally created and marked score lines to identify locations for said folds.

Still another embodiment provides a cover for a light source comprising a non-rigid material with a plurality of mountain and valley folds, wherein: (1) said folds create a rigid three-dimensional shape capable of covering a light source, (2) the rigid three-dimensional shape comprises a single piece of non-rigid material, and (3) the non-rigid material has digitally created and marked score lines to identify locations for said folds.

Still another embodiment provides a cover for a light source comprising a non-rigid material with a plurality of mountain and valley folds, wherein: (1) said folds create a rigid three-dimensional shape capable of covering a light source, (2) the non-rigid material is selected from the group consisting of paper, cardboard, synthetic material, and cotton paper, and (3) the rigid three-dimensional shape comprises a single piece of non-rigid material.

Still another embodiment provides a cover for a light source comprising a non-rigid material with a plurality of mountain and valley folds, wherein: (1) said folds create a rigid three-dimensional shape capable of covering a light source, (2) the non-rigid material is selected from the group consisting of paper, cardboard, synthetic material, and cotton paper, and (3) the non-rigid material has digitally created and marked score lines to identify locations for said folds.

Still another embodiment provides a cover for a light source comprising a non-rigid material with a plurality of mountain and valley folds, wherein: (1) said folds create a rigid three-dimensional shape capable of covering a light source, (2) the non-rigid material is selected from the group consisting of paper, cardboard, synthetic material, and cotton paper, (3) the rigid three-dimensional shape comprises a single piece of non-rigid material, and (4) the non-rigid material has digitally created and marked score lines to identify locations for said folds.

This disclosure also provides a method of making a cover for a light source comprising the steps of marking score patterns on a non-rigid material, folding said non-rigid material with mountain and valley folds according to the score patterns into a rigid three-dimensional shape, and placing said three dimensional shape over a light source.

Also disclosed is a method of making a cover for a light source comprising the steps of marking score patterns on a non-rigid material, folding said non-rigid material with mountain and valley folds according to the score patterns into a rigid three-dimensional shape, and placing said three dimensional shape over a light source, wherein the rigid three-dimensional shape comprises a single piece of non-rigid material.

Also disclosed is a method of making a cover for a light source comprising the steps of marking score patterns on a non-rigid material, folding said non-rigid material with mountain and valley folds according to the score patterns into a rigid three-dimensional shape, and placing said three dimensional shape over a light source, wherein the non-rigid material is selected from the group consisting of paper, cardboard, synthetic material, and cotton paper.

Also disclosed is a method of making a cover for a light source comprising the steps of marking score patterns on a non-rigid material, folding said non-rigid material with mountain and valley folds according to the score patterns into a rigid three-dimensional shape, and placing said three dimensional shape over a light source, wherein the score patterns are created and marked with one or more digital computer programs.

Also disclosed is a method of making a cover for a light source comprising the steps of marking score patterns on a non-rigid material, folding said non-rigid material with mountain and valley folds according to the score patterns into a rigid three-dimensional shape, and placing said three dimensional shape over a light source, wherein the light source is comprised of light-emitting diode (LED) lights.

Also disclosed is a method of making a cover for a light source comprising the steps of marking score patterns on a non-rigid material, folding said non-rigid material with mountain and valley folds according to the score patterns into a rigid three-dimensional shape, and placing said three dimensional shape over a light source, wherein: (1) the rigid three-dimensional shape comprises a single piece of non-rigid material and (2) the score patterns are created and marked with one or more digital computer programs.

Also disclosed is a method of making a cover for a light source comprising the steps of marking score patterns on a non-rigid material, folding said non-rigid material with mountain and valley folds according to the score patterns into a rigid three-dimensional shape, and placing said three-dimensional shape over a light source, wherein: (1) the rigid three-dimensional shape comprises a single piece of non-rigid material and (2) the light source is comprised of light-emitting diode (LED) lights.

Also disclosed is a method of making a cover for a light source comprising the steps of marking score patterns on a non-rigid material, folding said non-rigid material with mountain and valley folds according to the score patterns into a rigid three-dimensional shape, and placing said three-dimensional shape over a light source, wherein: (1) the non-rigid material is selected from the group consisting of paper, cardboard, synthetic material, and cotton paper and (2) the rigid three-dimensional shape comprises a single piece of non-rigid material.

Also disclosed is a method of making a cover for a light source comprising the steps of marking score patterns on a non-rigid material, folding said non-rigid material with mountain and valley folds according to the score patterns into a rigid three-dimensional shape, and placing said three-dimensional shape over a light source, wherein: (1) the non-rigid material is selected from the group consisting of paper, cardboard, synthetic material, and cotton paper and (2) the score patterns are created and marked with one or more digital computer programs.

Also disclosed is a method of making a cover for a light source comprising the steps of marking score patterns on a non-rigid material, folding said non-rigid material with mountain and valley folds according to the score patterns into a rigid three-dimensional shape, and placing said three-dimensional shape over a light source, wherein: (1) the non-rigid material is selected from the group consisting of paper, cardboard, synthetic material, and cotton paper and (2) the light source is comprised of light-emitting diode (LED) lights.

Also disclosed is a method of making a cover for a light source comprising the steps of marking score patterns on a non-rigid material, folding said non-rigid material with mountain and valley folds according to the score patterns into a rigid three-dimensional shape, and placing said three-dimensional shape over a light source, wherein: (1) the non-rigid material is selected from the group consisting of paper, cardboard, synthetic material, and cotton paper, (2) the rigid three-dimensional shape comprises a single piece of non-rigid material, and (3) the score patterns are created and marked with digital computer programs.

Also disclosed is a method of making a cover for a light source comprising the steps of marking score patterns on a non-rigid material, folding said non-rigid material with mountain and valley folds according to the score patterns into a rigid three-dimensional shape, and placing said three-dimensional shape over a light source, wherein: (1) the non-rigid material is selected from the group consisting of paper, cardboard, synthetic material, and cotton paper, (2) the rigid three-dimensional shape comprises a single piece of non-rigid material, and (3) the light source is comprised of light-emitting diode (LED) lights.

Also disclosed is a method of making a cover for a light source comprising the steps of marking score patterns on a non-rigid material, folding said non-rigid material with mountain and valley folds according to the score patterns into a rigid three-dimensional shape, and placing said three-dimensional shape over a light source, wherein: (1) the non-rigid material is selected from the group consisting of paper, cardboard, synthetic material, and cotton paper, (2) the rigid three-dimensional shape comprises a single piece of non-rigid material, (3) the score patterns are created and marked with digital computer programs, and (4) the light source is comprised of light-emitting diode (LED) lights.

Also disclosed is a three-dimensional structure folded from a single flat piece of non-rigid material comprising: a first outer side and a third outer side, wherein said first and third outer sides are spaced a distance apart, are parallel, and are of substantially the same length; a second outer side and a fourth outer side, wherein said second and fourth outer sides are spaced a distance apart, are parallel, and are of substantially the same length; a first group of parallel score lines consisting of a plurality of score lines which traverse the single flat piece of material from the second outer side to the fourth outer side being parallel and adjacent to the first and third outer sides, further being equally spaced apart relative to each other and relative to the first and third outer sides; a second group of parallel score lines comprising a plurality of score lines which traverse the single flat piece of material from the first outer side to the third outer side, are parallel to the second outer side and fourth outer side, and are spaced equal distances apart relative to each other and relative to the first and third outer sides; and a sixth group of score lines comprising a plurality of score lines which traverse the single flat piece of material from the first outer side to the third outer side, each score line comprising: a plurality of segments wherein a first segment begins at the first outer side, said plurality of segments proceeding at alternating substantially 45° angles to every score line of the first group of score lines, and a last segment terminating at the third outer side.

Also disclosed is a three-dimensional structure folded from a single flat piece of non-rigid material comprising: a first outer side and a third outer side, wherein said first and third outer sides are spaced a distance apart, are parallel, and are of substantially the same length; a second outer side and a fourth outer side, wherein said second and fourth outer sides are spaced a distance apart, are parallel, and are of substantially the same length; a first group of three parallel score lines which traverse the single flat piece of material from the second outer side to the fourth outer side being parallel and adjacent to the first outer side; a second group of three parallel score lines which traverse the single flat piece of material from the second outer side to the fourth outer side being parallel and adjacent to the first group of three parallel score lines; a third group of three parallel score lines which traverse the single flat piece of material from the second outer side to the fourth outer side being parallel and adjacent to the second group of three parallel score lines; a fourth group of three parallel score lines which traverse the single flat piece of material from the second outer side to the fourth outer side being parallel and adjacent to the third group of three parallel score lines and the third outer side; a fifth group of parallel score lines comprising a plurality of score lines which traverse the single flat piece of material from the first outer side to the third outer side, are parallel to the second outer side and fourth outer side, and are spaced equal distances apart relative to each other; and a sixth group of score lines comprising a plurality of score lines which traverse the single flat piece of material from the first outer side to the third outer side, each score line comprising: a first segment proceeding from the first outer side to a first line of the first group of three parallel score lines at a substantially 45° angle to the first outer side; a second segment proceeding from the first line of the first group of three parallel score lines to a second line of the first group of three parallel score lines at a substantially 45° angle such that the first segment and second segment form a substantially 90° angle; a third segment proceeding from the second line of the first group of three parallel score lines to a third line of the first group of three parallel score lines at a substantially 45° angle such that the third segment and second segment form a substantially 90° angle; a fourth segment proceeding from the third line of the first group of three parallel score lines to a first line of the second group of three parallel score lines at a substantially 45° angle such that the fourth segment and third segment form a substantially 90° angle; a fifth segment proceeding from the first line of the second group of three parallel score lines to a second line of the second group of three parallel score lines at a substantially 45° angle such that the fifth segment and fourth segment form a substantially 90° angle; a sixth segment proceeding from the second line of the second group of three parallel score lines to a third line of the second group of three parallel score lines at a substantially 45° angle such that the sixth segment and fifth segment form a substantially 90° angle; a seventh segment proceeding from the third line of the second group of three parallel score lines to a first line of the third group of three parallel score lines at a substantially 45° angle such that the seventh segment and sixth segment form a substantially 90° angle; an eighth segment proceeding from the first line of the third group of three parallel score lines to a second line of the third group of three parallel score lines at a substantially 45° angle such that the eighth segment and seventh segment form a substantially 90° angle; a ninth segment proceeding from the second line of the third group of three parallel score lines to a third line of the third group of three parallel score lines at a substantially 45° angle such that the ninth segment and eighth segment form a substantially 90° angle; a tenth segment proceeding from the third line of the third group of three parallel score lines to a first line of the fourth group of three parallel score lines at a substantially 45° angle such that the tenth segment and ninth segment form a substantially 90° angle; an eleventh segment proceeding from the first line of the fourth group of three parallel score lines to a second line of the fourth group of three parallel score lines at a substantially 45° angle such that the eleventh segment and tenth segment form a substantially 90° angle; a twelfth segment proceeding from the second line of the fourth group of three parallel score lines to a third line of the fourth group of three parallel score lines at a substantially 45° angle such that the twelfth segment and eleventh segment form a substantially 90° angle; and a thirteenth segment proceeding from the third line of the fourth group of three parallel score lines to the third outer side at a substantially 45° angle such that the thirteenth segment and twelfth segment form a substantially 90° angle.

BRIEF DESCRIPTION OF THE DRAWINGS

The features of this disclosure, and the manner of attaining them, will become more apparent and the disclosure itself will be better understood by reference to the following description of embodiments of the disclosure taken in conjunction with the accompanying drawings.

Figure 1:
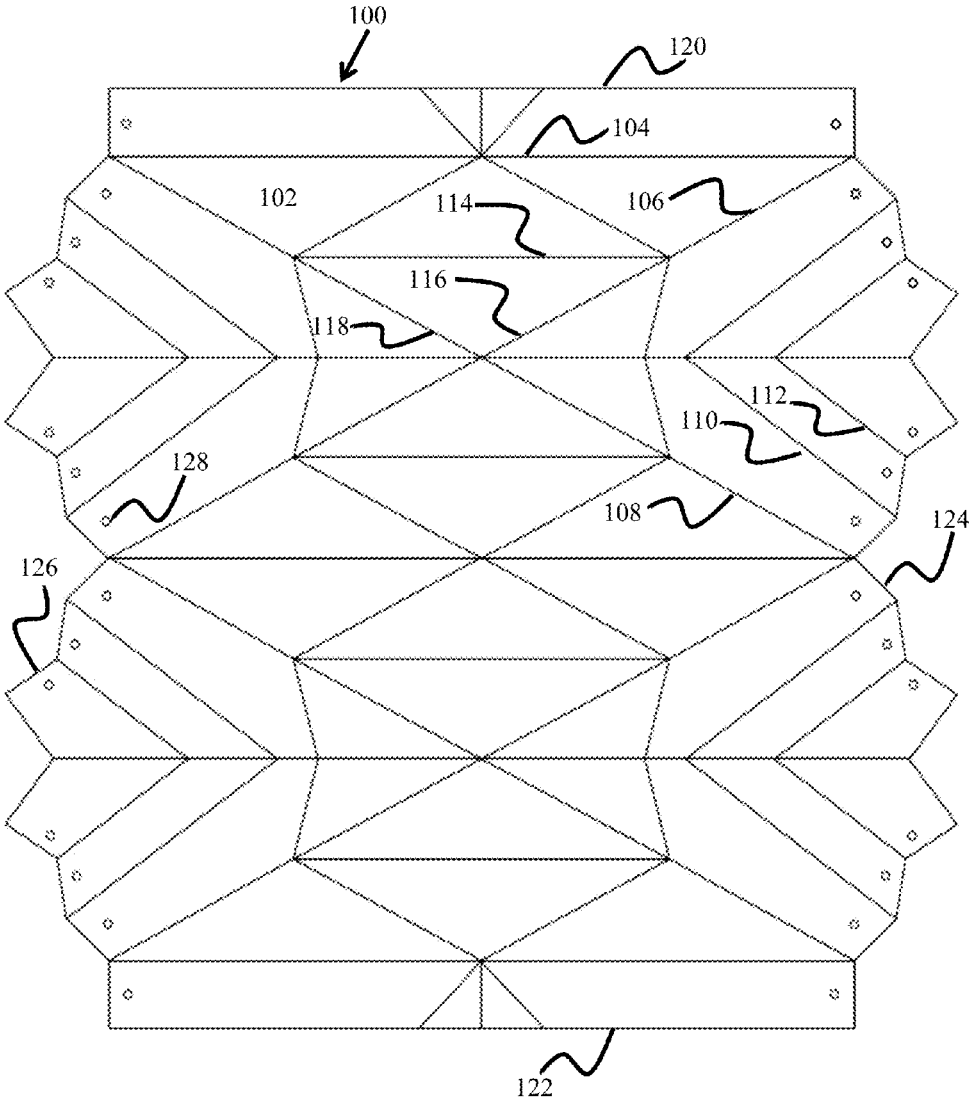
FIGS. 1-4 are top plan views of exemplary two-dimensional score patterns on a substantially flat, non-rigid material.

Corresponding reference characters indicate corresponding parts throughout the several views. Although the drawings represent embodiments of the present disclosure, the drawings are not necessarily to scale and certain features may be exaggerated in order to better illustrate and explain the present disclosure. The exemplifications set out herein illustrate an exemplary embodiment of the disclosure, in one form, and such exemplifications are not to be construed as limiting the scope of the disclosure in any manner.

DETAILED DESCRIPTION OF THE DRAWINGS

The embodiments disclosed herein are not intended to be exhaustive or limit the disclosure to the precise form disclosed in the following detailed description. Rather, the embodiments are chosen and described so that others skilled in the art may utilize their teachings.

Referring first to FIG. 1, an exemplary two-dimensional score pattern 100 on a non-rigid material 102 is provided. By way of example, non-rigid material 102 can include any non-rigid material that when folded with a series of mountain and valley folds retains a rigid three-dimensional shape. In some embodiments, non-rigid material 102 is paper, such as cotton paper, and in other embodiments is synthetic material able to be scored and folded, such as Tyvek paper. The term non-rigid material also contemplates any material that is non-rigid in a two-dimensional form, such as thin cardboard, but is of sufficient rigidity when scored and folded to form a three-dimensional cover for a light source.

Score pattern 100 is comprised of a plurality of score lines 104, also referred to as crease lines herein. Score lines 104, in some embodiments, are indentations made in non-rigid material 102 by a hand tool or by an automated device, such as a digital cutter. In other embodiments, score lines 104 are partial cuts in non-rigid material 102. Still in other embodiments, score lines 104 are a printed pattern made by ink or a substantially similar substance, such as graphite.

As shown in FIG. 1, score lines 106, 108 lie in different directions. Score lines 110, 112 lie in the same direction and are parallel. Score lines 108, 110 lie in substantially the same direction and are substantially parallel. Score lines 114, 116, 118 form a substantially triangular shape. Any configuration for score lines 104 is envisioned as long as score lines 104 can be folded in a series of mountain and valley folds (described further below) into a rigid three-dimensional structure.

Material 102 includes opposing sides 120, 122 which are parallel. In the embodiment shown, opposing sides 124, 126 are not parallel. In some embodiments, non-rigid material 102 has more or fewer than four sides. In some embodiments, all opposing sides are parallel. In other embodiments, no opposing sides are parallel. As shown by FIG. 1, score lines 104 form complex patterns or grids with parallel and non-parallel lines. In other embodiments, score lines 104 can form simple patterns composed of repeating units.

In some embodiments, score lines 104 can be made by a hand-held implement with a point. In other embodiments, a digital cutter may be used, either by itself or in combination with a hand-held implement, to imprint or mark score lines 104 without fully cutting through non-rigid material 102. In one exemplary embodiment, the digital cutter is a Graphtec digital vinyl cutter. Still referring to FIG. 1, holes 128 are punched into non-rigid material 102, optionally with a hand-held and/or automated tool, to finalize the three-dimensional shape of the light covering when non-rigid material 102 is folded. For example, a string or thin cord might be run through one or more holes 128 in order to place non-rigid material 102 around a light source once folded.

Figure 2:
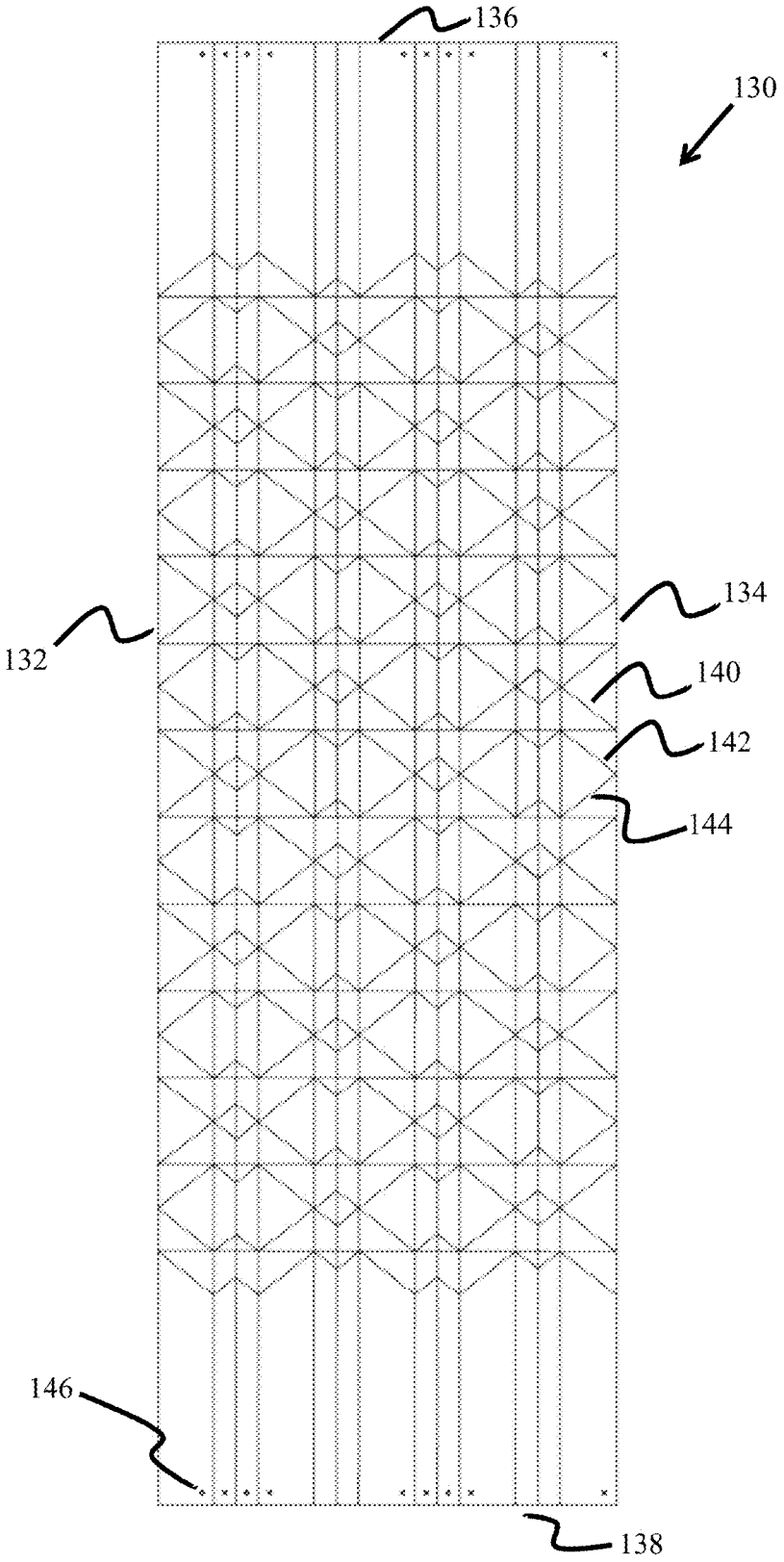
Figure 6:
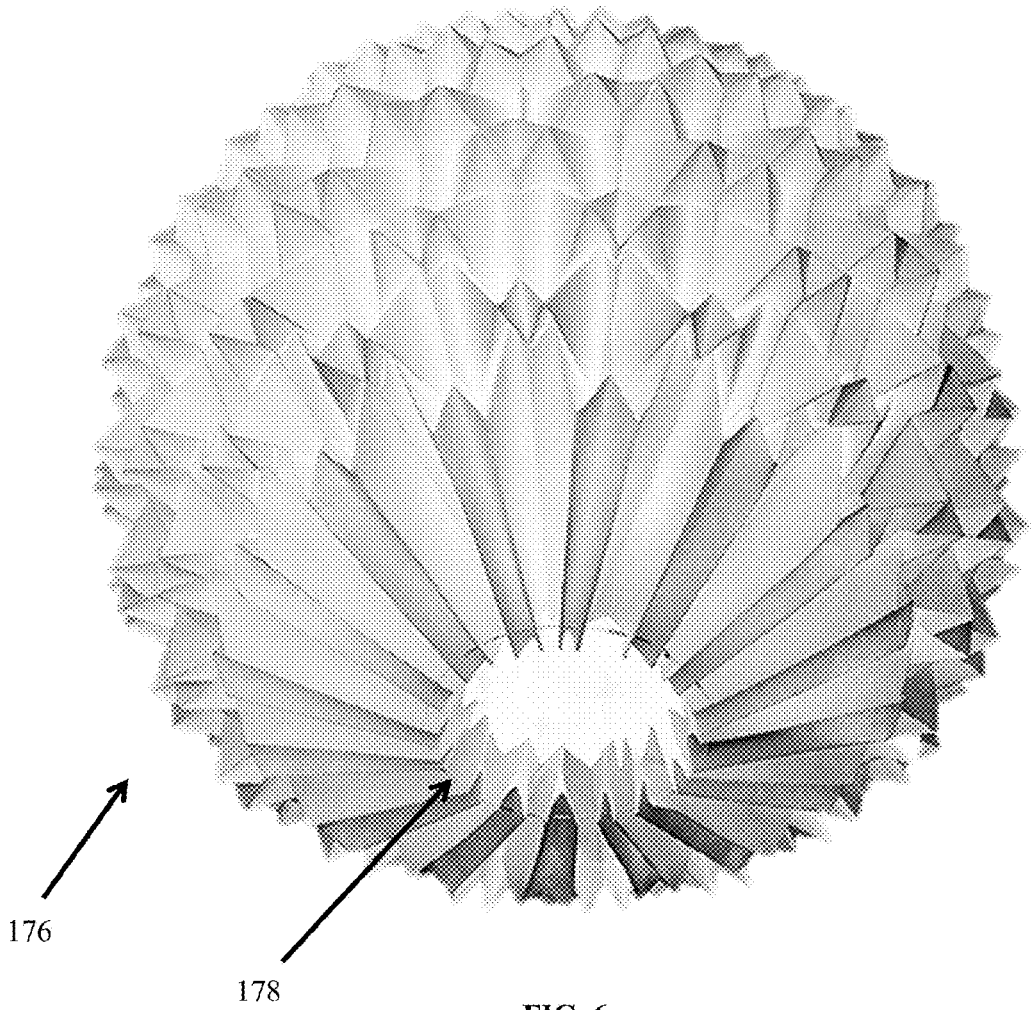
Figure 12:
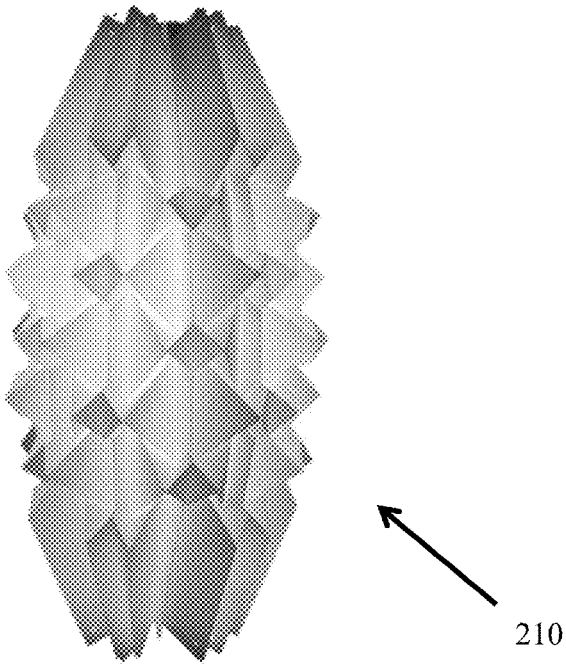
FIG. 12 is a perspective view of one embodiment of a three-dimensional oblong shape formed from the score pattern of FIG. 2.

Referring now to FIG. 2, one portion of a two-dimensional score pattern 130 is provided, which in some embodiments can be folded to attain the three-dimensional shapes shown in FIG. 6 and FIG. 12. Depending on the size of the flat material onto which pattern 130 is scored or printed, smaller or larger three-dimensional shapes will be achieved with folding. For example, if pattern 130 extended further in the horizontal direction, a larger three-dimensional shape would be obtained.

In the embodiment shown, opposing sides 132, 134 are parallel and of the same length. Similarly, opposing sides 136, 138 are parallel and of the same length. In some embodiments, opposing sides 132, 134, 136, 138 can be parallel and of differing lengths. In other embodiments, opposing sides 132, 134, 136, 138 can be not parallel and of differing lengths. Still in other embodiments, opposing sides 132, 134, 136, 138 can be not parallel and of the same length.

Still referring to FIG. 2, score lines 140, 142 lie substantially parallel to one another, while score lines 142, 144 lie in different directions disposed at substantially a 90° right angle to one another. Score pattern 130 includes a plurality of holes 146, which, similar to holes 128 in FIG. 1, are used for finalizing the three dimensional shape of the light covering, optionally with a string or cord.

Figure 3:
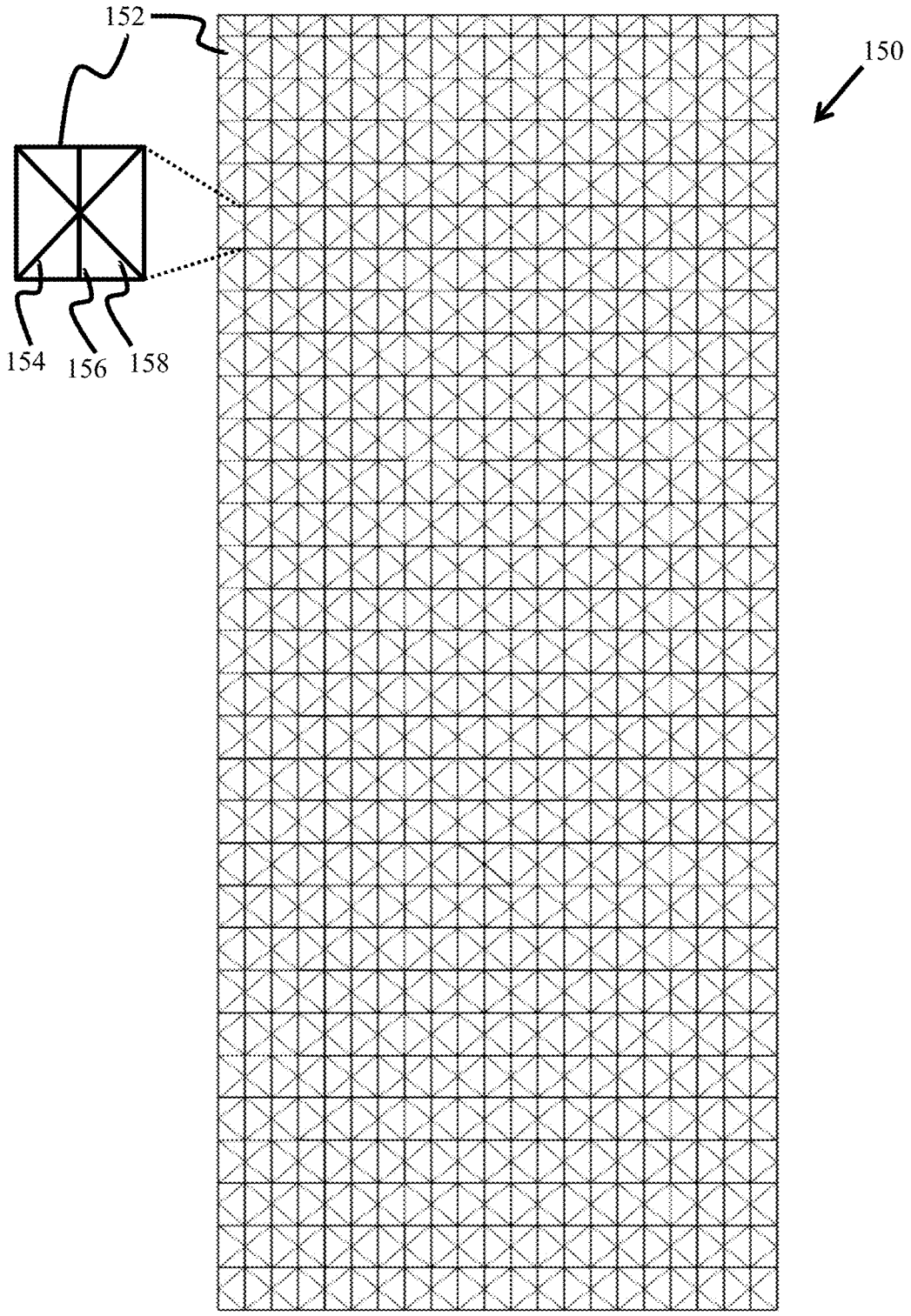

Referring now to FIG. 3, score pattern 150 is provided. Score pattern 150 includes a series of repeating units 152. One such unit is shown as enlarged in FIG. 3. Score lines 154, 158 are disposed at substantially 103° angles to one another, and score line 156 is disposed at substantially 51° angles to both score lines 154, 158. In other embodiments, other angles preferably between 1° and 90° could be used. Still in other embodiments, different configurations of score lines within repeating units 152 can be used, so long as a series of mountain and valley folds can be made in score pattern 150 to provide rigidity to pattern 150 in a three-dimensional shape. Additionally, alternative configurations for repeating units 152 are envisioned, such as non-repeating units placed in between or dispersed amongst repeating units 152. FIG. 3 provides one exemplary two-dimensional score pattern to attain the shape of FIG. 7 with a series of mountain and valley folds.

Figure 4:
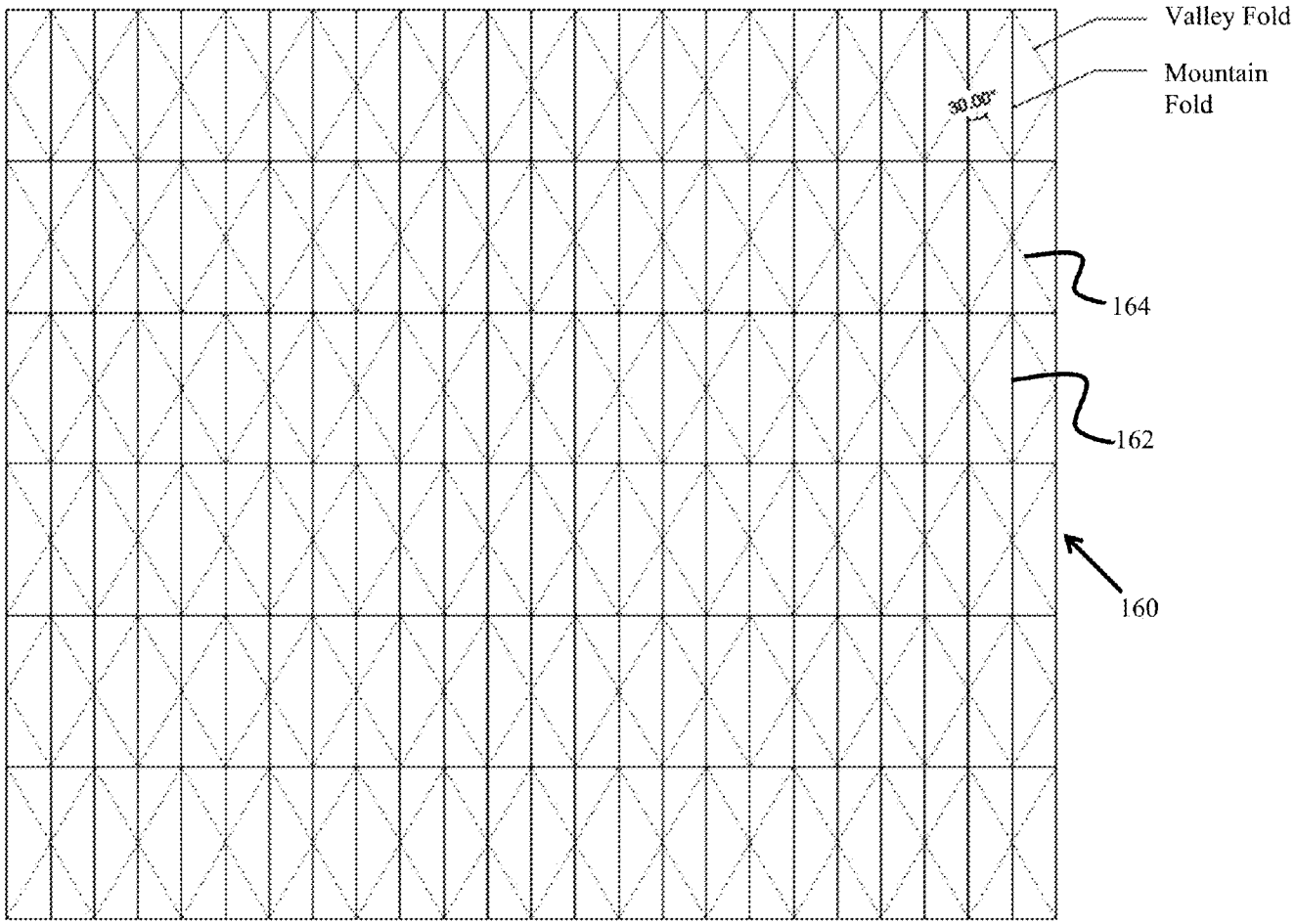

Referring now to FIG. 4, score pattern 160 includes a plurality of vertical, parallel score lines 162, shown with solid lines, and a plurality of diagonal score lines 164, shown with dotted lines. As shown in FIG. 4, score lines 164 are disposed at 30.00° angles relative to parallel score lines 162. In other embodiments, other angles of between about 1° and about 90° could be used.

In the embodiment of FIG. 4, score lines 162 are folded as mountain folds, and score lines 164 are folded as valley folds. Such folds may be made by hand by a person, or may be made by an automated device capable of detecting score lines 162, 164. Mountain folds refer to folds made in an upward direction relative to a flat, two-dimensional plane formed by score pattern 160 as it lies flat. Valley folds refer to folds made in a downward direction relative to a flat, two-dimensional plane formed by score pattern 160 as it lies flat. Mountain and valley folds, once creased, are disposed opposite to one another.

Figure 5:
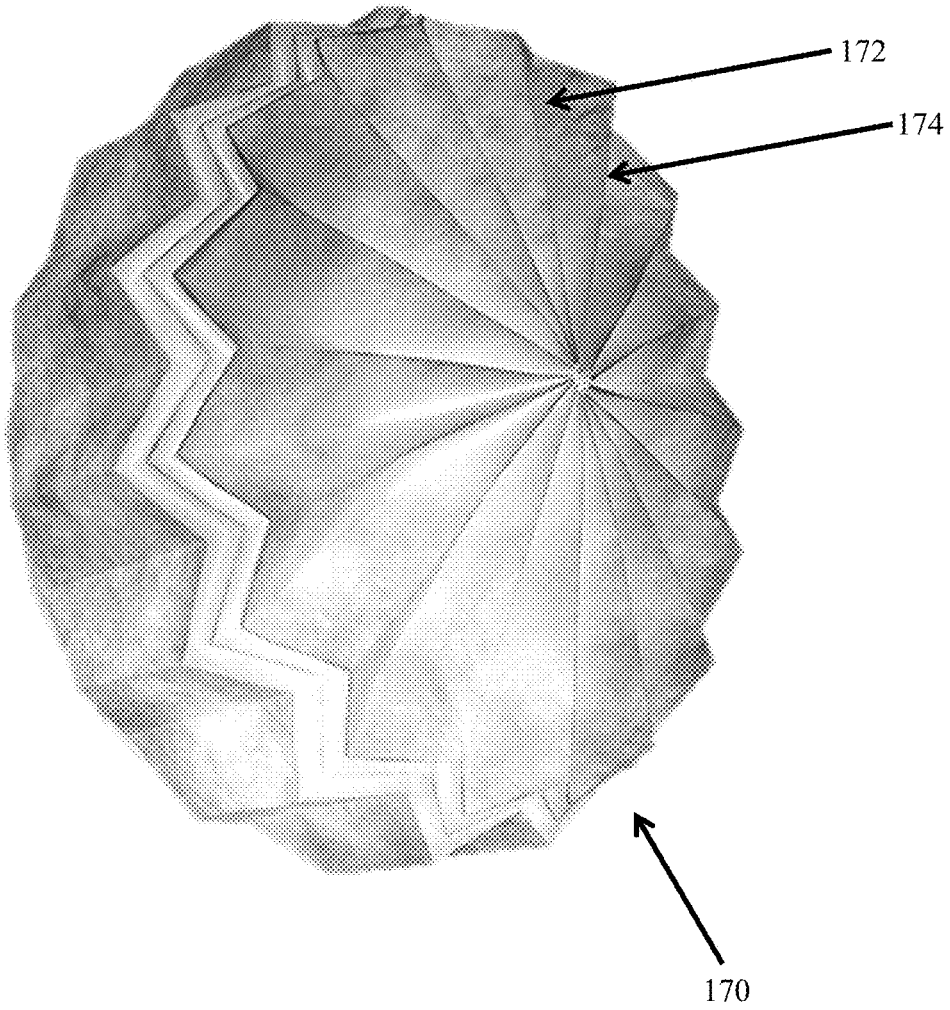
FIGS. 5-8 are perspective views of exemplary three-dimensional structures folded from a non-rigid material.

Referring now to FIGS. 5-8, exemplary three-dimensional structures folded from flat pieces of non-rigid material are shown. As shown in FIG. 5, three-dimensional light covering 170 includes valley folds 172 and mountain folds 174. Folds 172, 174 provide structure, three-dimensional shape, and rigidity to the piece of flat, non-rigid material 102 which forms three-dimensional light covering 170. Light covering 170, in one embodiment, is hung from a ceiling, optionally using a string or cord in combination with holes similar to holes 128 of FIG. 1, over a light source such as, for example, one or more standard incandescent and/or LED light bulbs.

Referring now to FIG. 6, a substantially spherically-shaped three-dimensional covering 176 for a light source, with a plurality of mountain and valley folds, is shown. Disposed near the bottom of covering 176 is a string or cord 178 which is disposed within a series of holes, optionally similar to holes 128 of FIG. 1 or holes 146 of FIG. 2. Cord 178, in some embodiments, is used to add stability to covering 176 and/or to help position covering 176 over a light source.

Figure 7:
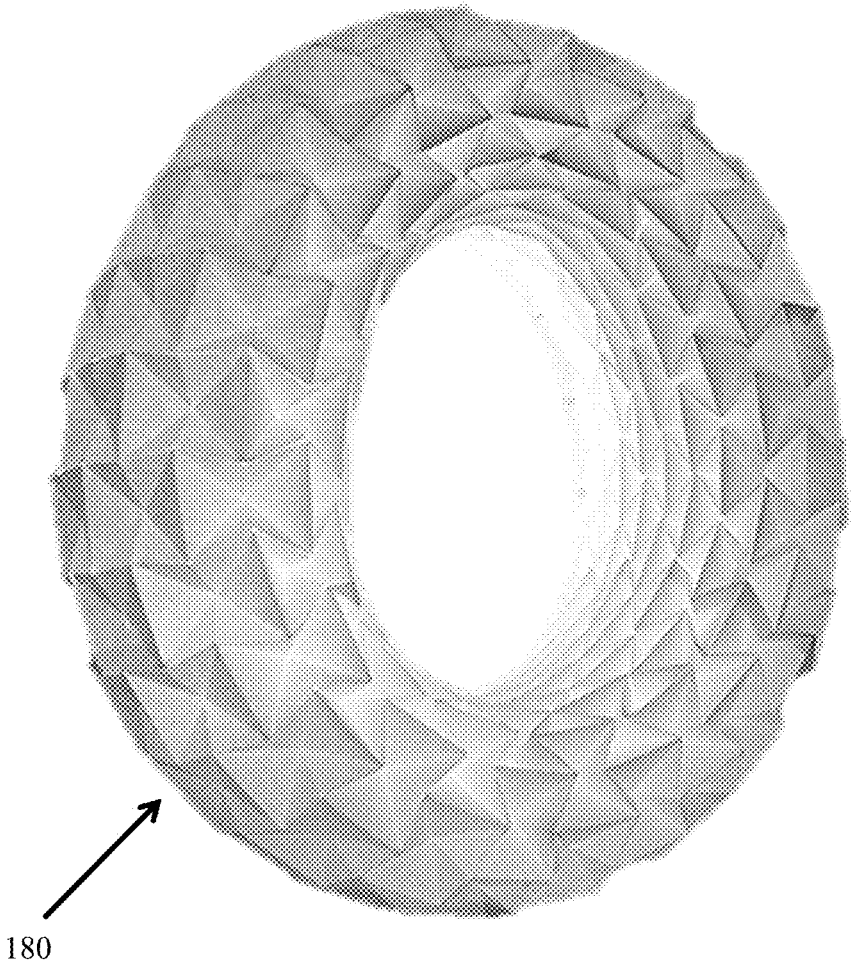

Referring now to FIG. 7, a torus-shaped, rigid three-dimensional light covering 180 is shown. FIG. 3 provides one exemplary two-dimensional score pattern to attain the shape of FIG. 7 with a series of mountain and valley folds. The mountain and valley folds provide stability and rigidity to covering 180. In some embodiments, covering 180 houses one light source, but in other embodiments covering 180 can house more than one light source, preferably LED light bulbs.

Figure 8:
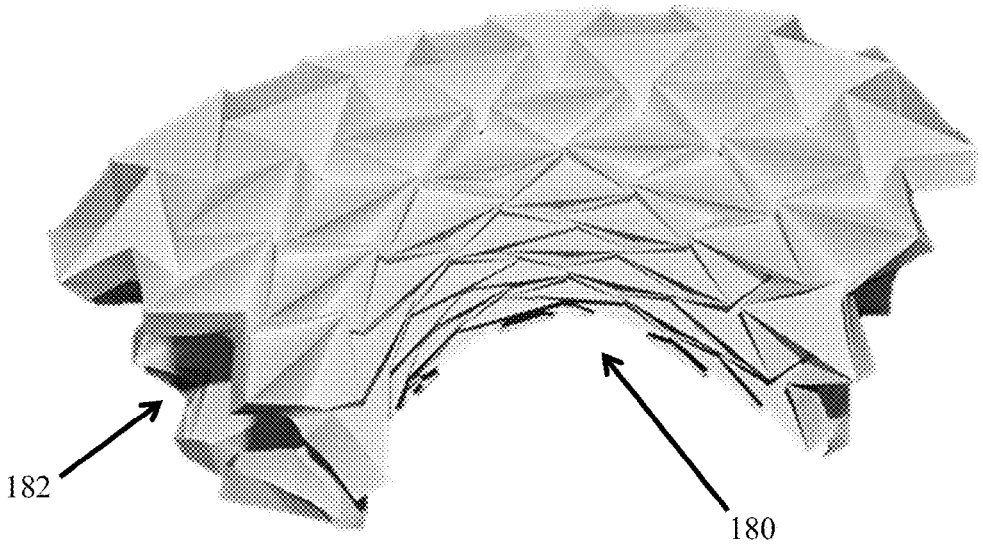

FIG. 8 shows a perspective view of covering 180 of FIG. 7. As can be seen, hollow portion 182 exists within covering 180. Hollow portion 182 is used to house one or more light sources such as, for example, LED light bulbs.

Figure 9:
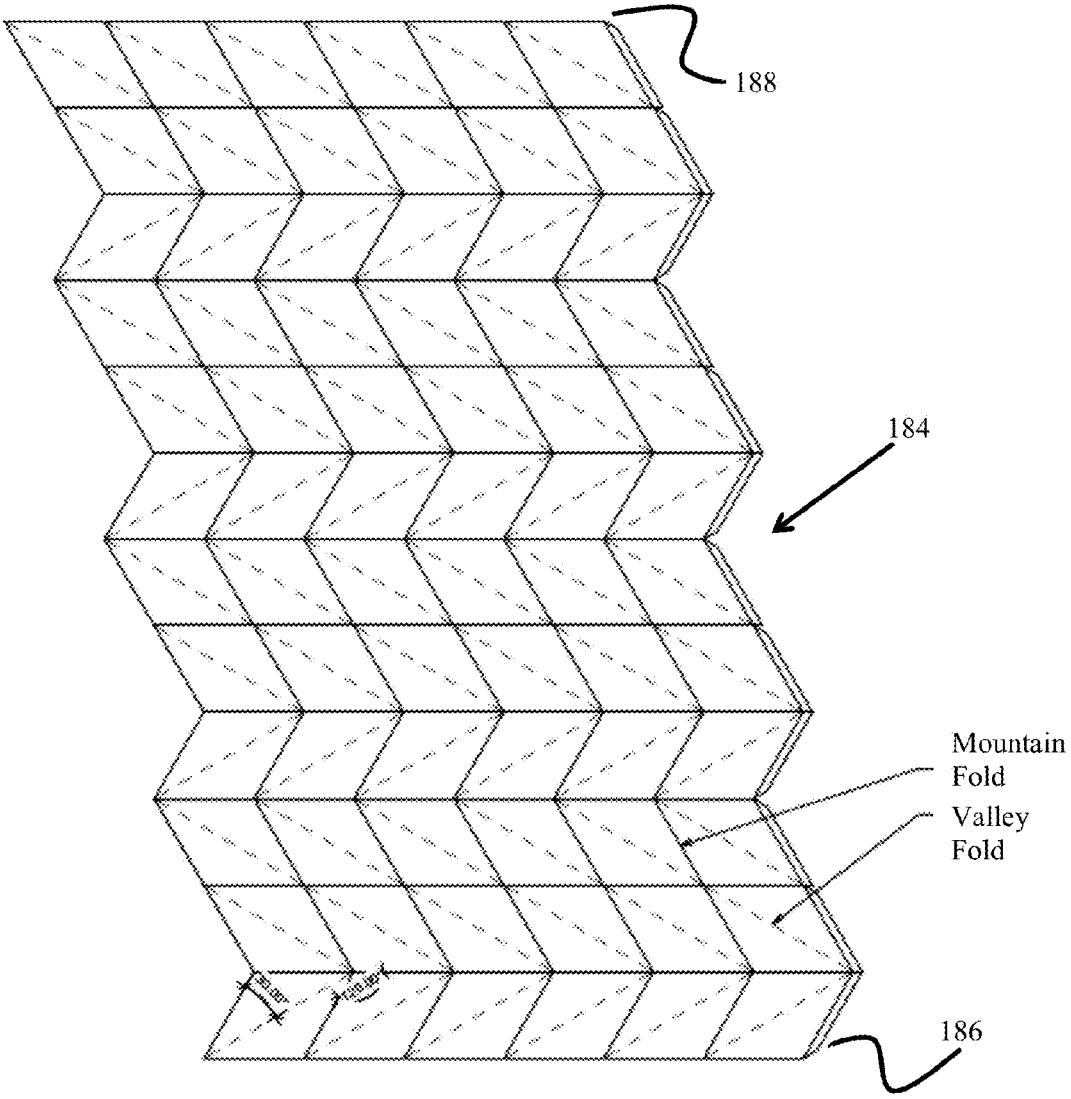
FIGS. 9-10 are perspective views of exemplary two-dimensional, single, flat pieces of non-rigid material being folded according to a score pattern with mountain and valley folds.
Figure 10:
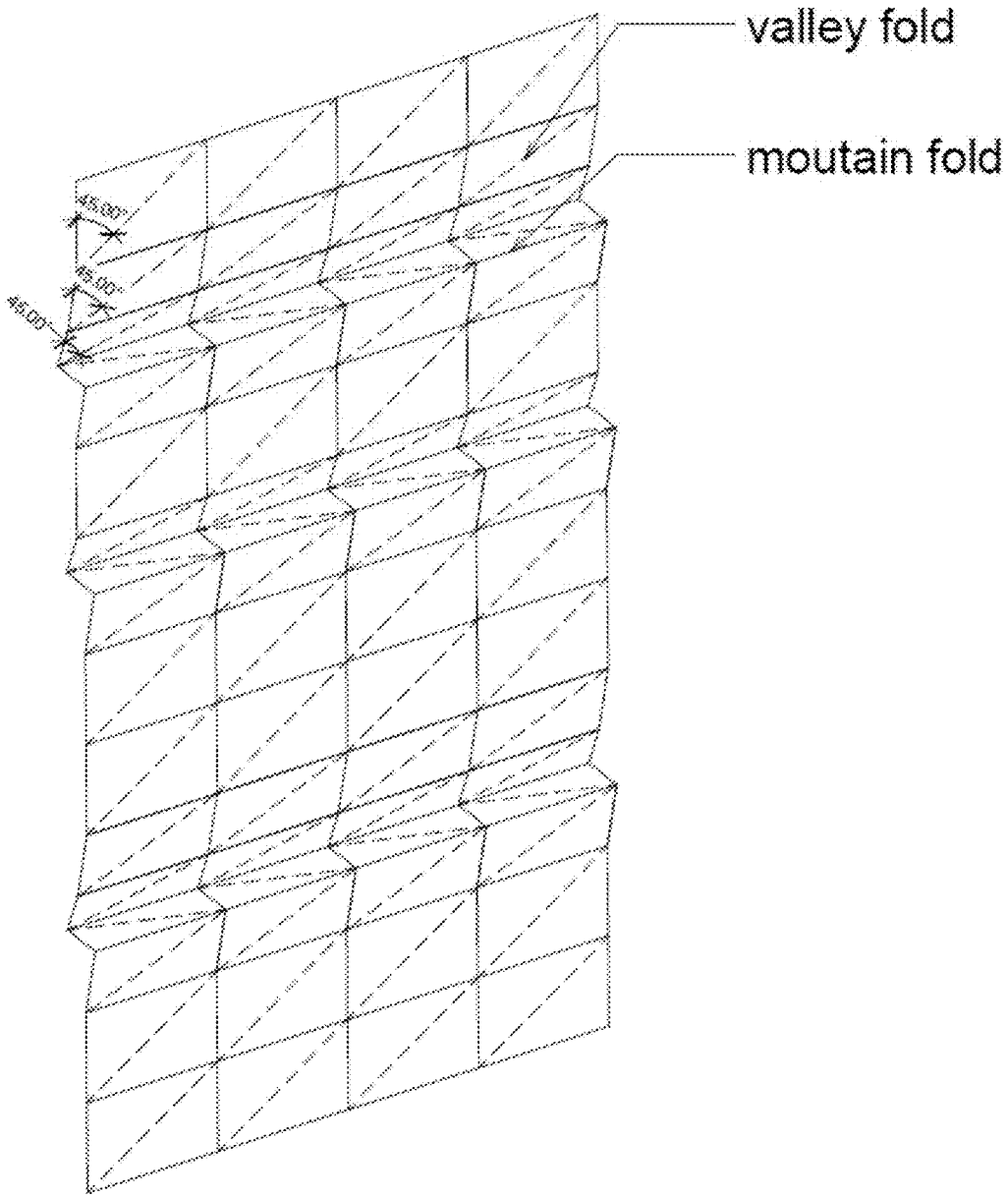

FIGS. 9-10 illustrate exemplary two-dimensional, single, flat pieces of non-rigid material being folded according to score patterns with mountain and valley folds. Referring now to FIG. 9, score pattern 184 has solid, vertical and horizontal lines representing locations where mountain folds are to be made, and dotted, diagonal lines representing locations where valley folds are to be made. In the embodiment shown, there are 30° angles between the solid vertical lines and the dotted, diagonal lines. In other embodiments, other angles of between about 1° and about 90° could be used.

Still referring to FIG. 9, lower portion 186 and upper portion 188 are shown. In some embodiments, score pattern 184 may be extended partially or wholly as a table and/or floor lamp, wherein lower portion 186 is connected to a base resting on a table or the floor, and upper portion 188 is extended upwardly relative to the base. Pattern 184 can provide an easy storage, shipping, and/or sale condition in which the pattern is compressed, with upper portion 188 disposed proximate to lower portion 186, and easily expandable for use as a light covering by an end user.

Referring now to FIG. 10, solid, horizontal lines represent locations where mountain folds are to be made, and dotted, diagonal lines represent locations where valley folds are to be made. In the embodiment shown, there are 45° angles between the solid horizontal lines and the dotted, diagonal lines. In other embodiments, other angles of between about 1° and about 90° could be used.

Figure 11:
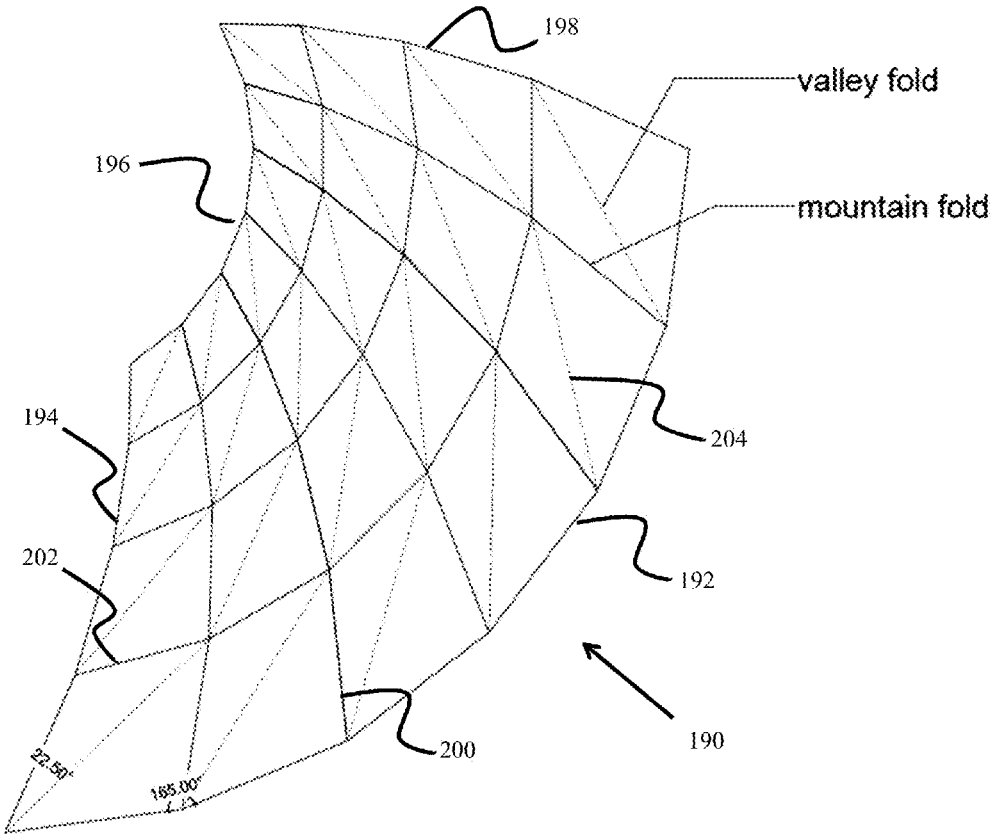
FIG. 11 is a top plan view of a two-dimensional score pattern on a non-rigid material for a hexagonal swirl.

Referring now to FIG. 11, a two-dimensional score pattern 190 on a non-rigid material for a hexagonal swirl is shown. Score pattern 190 has first side 192, second side 194, third side 196, and fourth side 198. In the embodiment shown, third side 196 is shorter in length between second side 194 and fourth side 198 than first side 192 is in length between second side 194 and fourth side 198. Plurality of score lines 200 proceeds from first side 192 to third side 196. Score lines 200 are folded as mountain folds. Plurality of score lines 202 proceeds from second side 194 to fourth side 198. Score lines 202 also are folded as mountain folds.

Score pattern 190 includes diagonal score lines 204, which in the embodiment shown are folded as valley folds. As noted above, mountain folds refer to folds made which place portions of score pattern 190 upward relative to a plain formed by score pattern 190 in its two-dimensional form, and valley folds refer to folds made which place portions of score pattern 190 downward relative to a plain formed by score pattern 190 in its two-dimensional form.

Referring now to FIG. 12, one embodiment of a three-dimensional oblong shape 210 formed from the pattern of FIG. 2 is shown. As explained above, score pattern 130 of FIG. 2 could, in some embodiments, create substantially spherically-shaped three-dimensional covering 176 shown in FIG. 6, and score pattern 130 of FIG. 2 can also create oblong shape 210 of FIG. 12. If score pattern 130 is scored or printed on a larger two-dimensional flat sheet of material, a larger shape such as that of FIG. 6 may be obtained through a series of mountain and valley folds. If score pattern 130 is scored or printed on a smaller two-dimensional flat sheet of material, a smaller and/or otherwise differently shaped three-dimensional structure such as that of FIG. 12 may be obtained.

Figure 13:
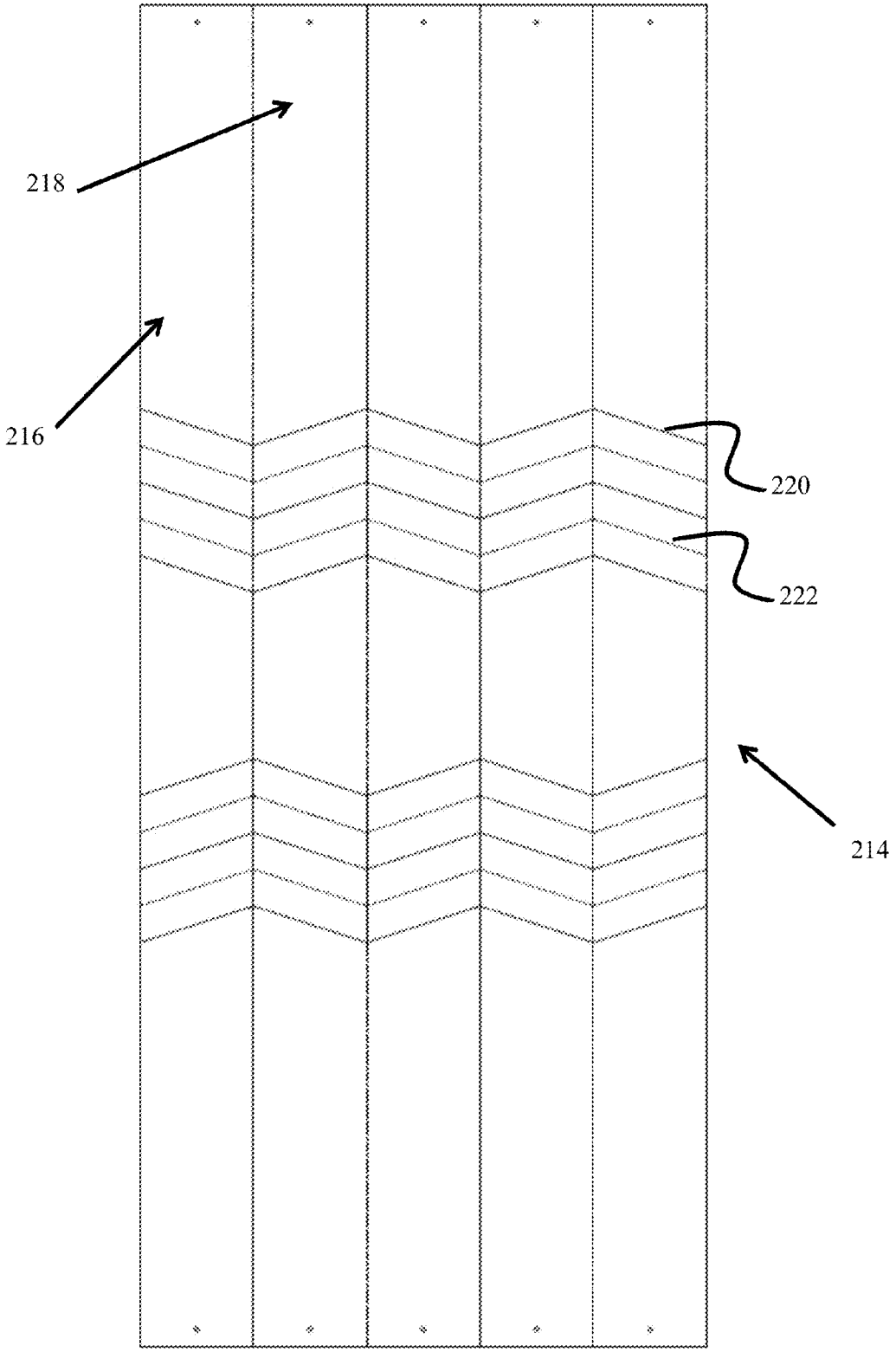
FIG. 13 is a top plan view of one embodiment of a score pattern that can be folded to create the three-dimensional light covering of FIG. 5.

Referring to FIG. 13, a portion of a score pattern 214 is shown, which can be folded to create three-dimensional light covering 170 of FIG. 5. A series of repeating units 216, 218 form score pattern 214, and the number of repeating units 216, 218 can be more or fewer than the number shown in FIG. 13. Mountain folds 220 are shown by solid lines and valley folds 222 are shown by dotted or broken lines. Once again, if a flat two-dimensional piece of material was large and pattern 214 were printed on the large piece of material, possibly in different ratios and/or with more repeating units 216, 218, then a larger and/or differently-shaped version of three-dimensional light covering 170 of FIG. 5 would be obtained.

Alternatively, if a flat two-dimensional piece of material was small and pattern 214 were printed on the small piece of material, possibly in different ratios and/or with fewer repeating units 216, 218, then a smaller and/or differently-shaped version of three-dimensional light covering 170 of FIG. 5 would be obtained.

Figure 14:
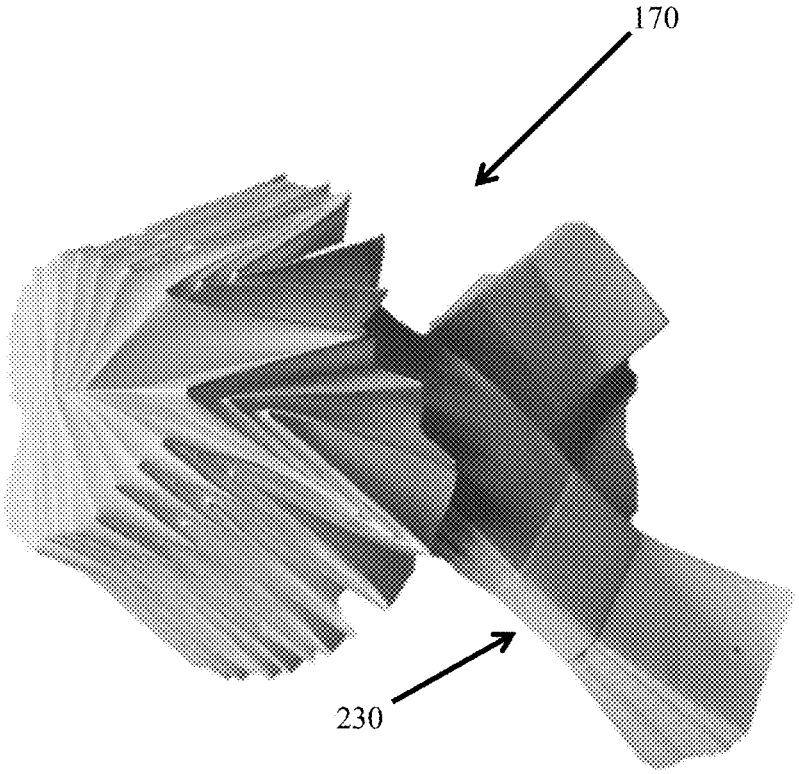
FIG. 14 is a perspective view of the three-dimensional light covering of FIG. 5 in a compressed or packaged form for easy shipping, handling, storage, and/or display.

Referring now to FIG. 14, three-dimensional light covering 170 of FIG. 5 is shown in a compressed or packaged form for easy shipping, handling, storage, and/or display. One or more removable straps 230, or similar removable restraining means such as tape, can be used to maintain the compressed form. The three-dimensional shapes of the present disclosure are able to be compressed such as is shown in FIG. 14 for ease of the user to handle the shapes before they are shipped, displayed, purchased, and/or in use. After being compressed, the shapes of the present disclosure are easily expandable by the end user when straps 230 are removed. Thus, after removing straps 230, the expanded form of three-dimensional light covering 170 of FIG. 5 could be disposed over a light source.

Figure 15:
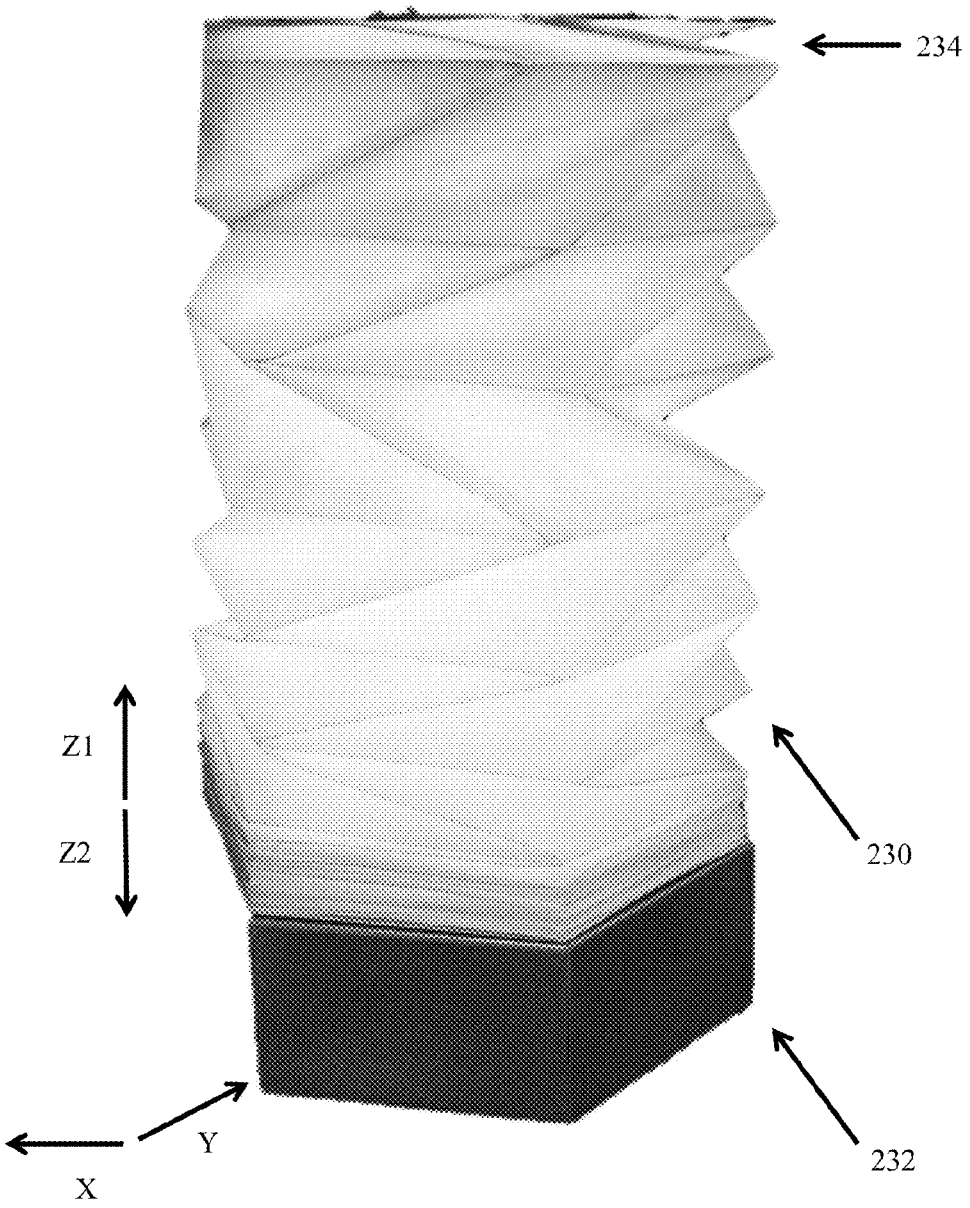
FIG. 15 is a perspective view of a three-dimensional light covering formed from the score pattern and folds of FIG. 9.

Referring now to FIG. 15, a perspective view of a three-dimensional light covering 230 formed from the score pattern and folds of FIG. 9 is shown. Light covering 230 is disposed on top of base 232. Once folded with a series of mountain and valley folds, light covering 230 is rigid or stable in the horizontal plane (X, Y plane) and is optionally vertically flexible (Z1, Z2 directions). Thus, light covering 230 could be compressed in the Z2 direction for compact storage, movement, and/or shipping. Light covering 230 is then expanded in the Z1 direction for use as a light covering of a light source within covering 230. Upper support 234 is disposed on top of light covering 230, and upper support 234 can contribute to structurally supporting covering 230 in the Z1 direction. For example, a string or cord from above support 234 could hold support 234 stable, thus supporting covering 230 in the Z1 direction. Alternatively, a support within covering 230 such as a wire, spring, and/or any other means known in the art with sufficient strength to support covering 230 in the Z1 direction could be used to hold covering 230 in an expanded state.

Figure 16:
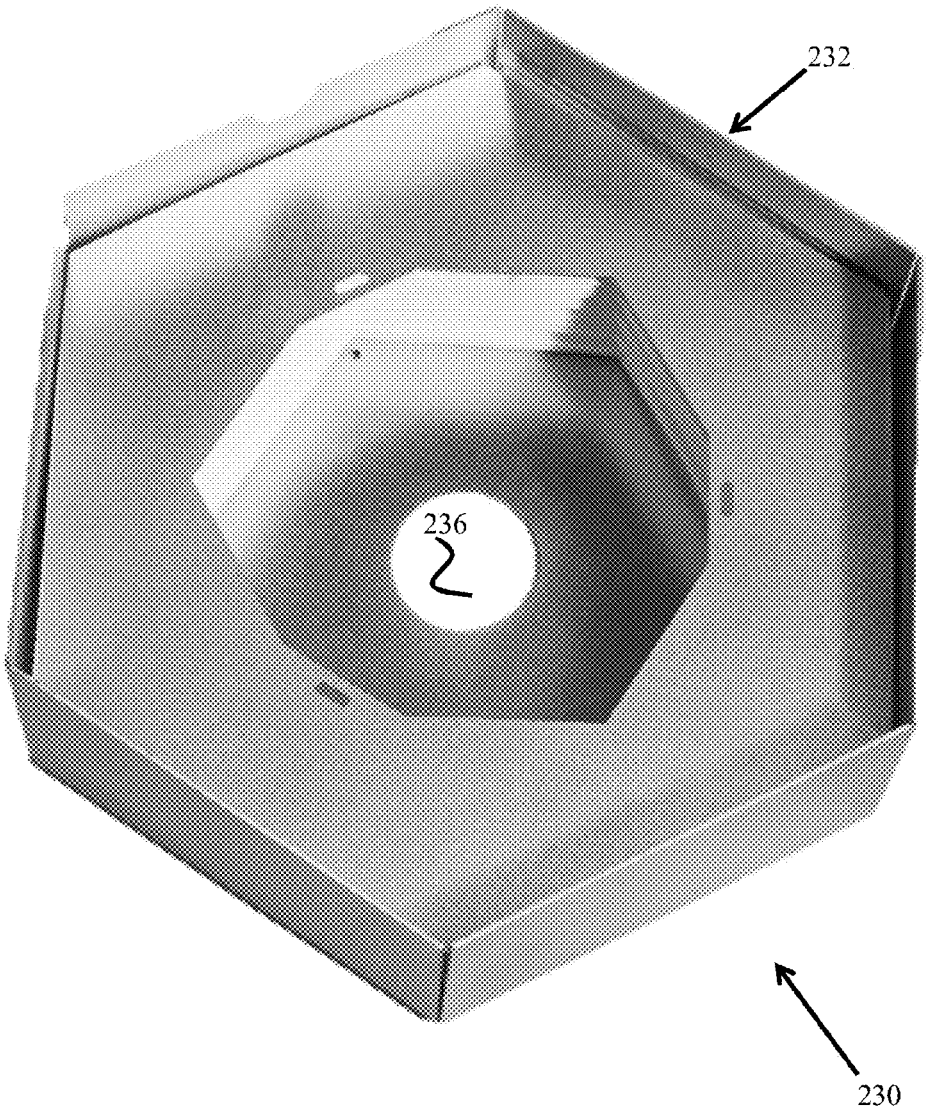
FIG. 16 is a top plan view of the three-dimensional light covering of FIG. 15 in a compressed state.

Referring now to FIG. 16, a top plan view of three-dimensional light covering 230 of FIG. 15 is shown in a compressed state. Light covering 230 could be compressed in the Z2 direction for compact storage, movement, and/or shipping. Light covering 230 is then expanded in the Z1 direction for use as a light covering of a light source within covering 230. Opening 236 is shown within base 232, wherein one or more light sources could be disposed, such as, for example LED lights.

Figure 17:
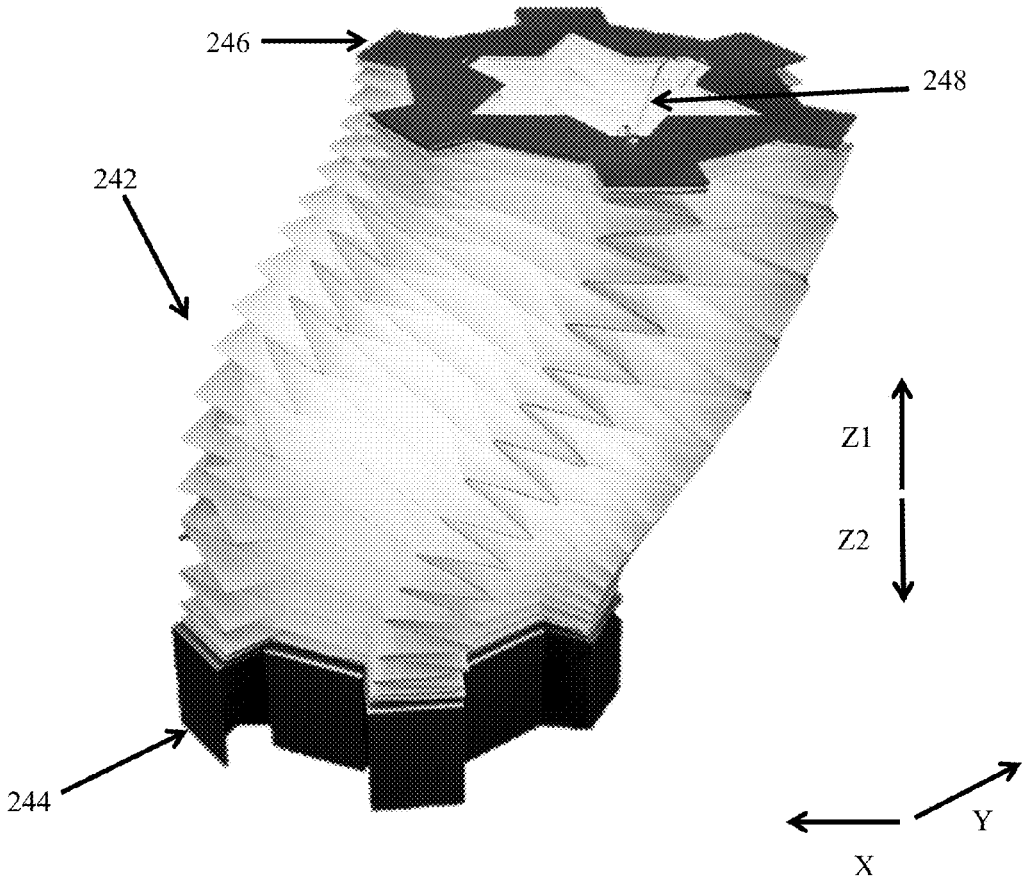
FIG. 17 is a perspective view of a three-dimensional light covering formed from the score pattern and folds of FIG. 4.

Referring now to FIG. 17, a perspective view of a three-dimensional light covering 242 formed from the score pattern and folds of FIG. 4 is shown. Light covering 242 is disposed on top of base 244. Once folded with a series of mountain and valley folds, light covering 242 is rigid or stable in the horizontal plane (X, Y plane) and is optionally vertically flexible (Z1, Z2 directions). Thus, light covering 242 could be compressed in the Z2 direction for compact storage, movement, and/or shipping. Light covering 242 is then expanded in the Z1 direction for use as a light covering of a light source within covering 242. Upper support 246 is disposed on top of light covering 242, and upper support 246 can contribute to structurally supporting covering 242 in the Z1 direction. For example, a string or cord from above support 246 could hold support 246 stable, thus supporting covering 242 in the Z1 direction. Alternatively, a support within covering 242 such as wire 248, a spring, and/or any other means known in the art with sufficient strength to support covering 242 in the Z1 direction could be used to hold covering 242 in an expanded state. As shown, wire 248 supports covering 242 in the Z1 direction by supporting upper support 246. More or fewer wires could be used alone or in combination with any combination of springs, cords, strings, and/or any other similar support means known in the art.

Base 244 and upper support 246, in some embodiments, are comprised of the same material as covering 242, but in other embodiments either or both base 244 and upper support 246 are made of material more rigid than the material of light covering 242.

Figure 18:
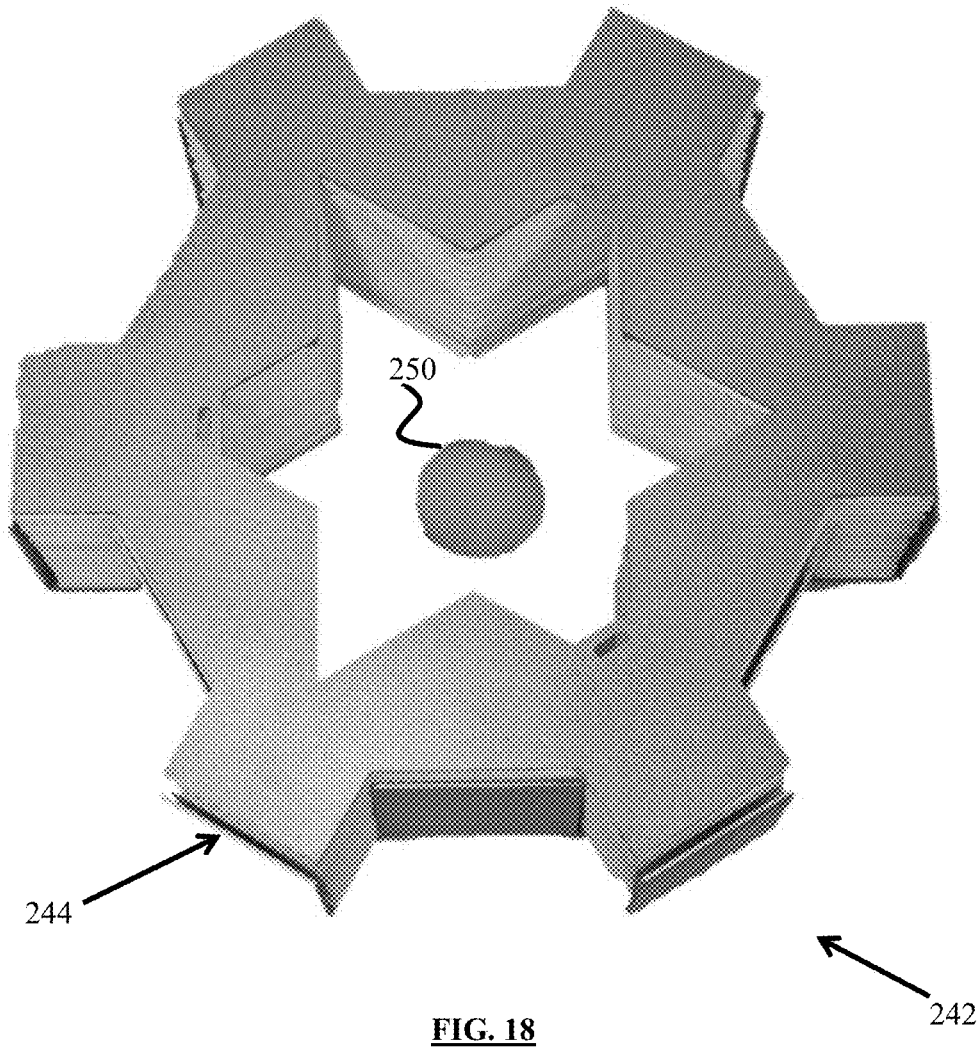
FIG. 18 is a top plan view of the three-dimensional light covering of FIG. 17 in a compressed state.

Referring now to FIG. 18, a top plan view of the three-dimensional light covering of FIG. 17 is shown in a compressed state. Light covering 242 could be compressed in the Z2 direction for compact storage, movement, and/or shipping. Light covering 242 is then expanded in the Z1 direction for use as a light covering of a light source within covering 242. Light source 250 is shown within base 244, wherein one or more light sources could be disposed, such as, for example LED lights.

While this disclosure has been described as having an exemplary design, the present disclosure may be further modified within the spirit and scope of this disclosure. This application is therefore intended to cover any variations, uses, or adaptations of the disclosure using its general principles. Further, this application is intended to cover such departures from the present disclosure as come within the known or customary practice in the art to which this disclosure pertains.

What is claimed is:

1. A cover for a light source comprising:

a non-rigid material including:

a first outer side and a third outer side, wherein said first and third outer sides are spaced a distance apart, are parallel, and are of substantially the same length, a second outer side and a fourth outer side, wherein said second and fourth outer sides are spaced a distance apart, are parallel, and are of substantially the same length, a first group of parallel score lines comprising a plurality of score lines which traverse the material between the second outer side and the fourth outer side being parallel and adjacent to the first and third outer sides, further being equally spaced apart relative to each other and relative to the first and third outer sides, a second group of parallel score lines comprising a plurality of score lines which traverse the material between the first outer side and the third outer side, are parallel to the second outer side and fourth outer side, and are spaced equal distances apart relative to each other and relative to the first and third outer sides, and a third group of score lines comprising a plurality of score lines which traverse the material between the first outer side and the third outer side, wherein the score lines are digitally created and identify locations for a plurality of mountain and valley folds, wherein said folds create a rigid three-dimensional light source cover.

2. The cover of claim 1 wherein the rigid three-dimensional light source cover comprises a single piece of non-rigid material.

3. The cover of claim 1 wherein the non-rigid material is selected from the group consisting of paper, cardboard, synthetic material, and cotton paper.

4. The cover of claim 1 wherein the non-rigid material has digitally created and marked score lines to identify locations for said folds, and wherein the non-rigid material provides an expanded and compressed three-dimensional shape.

5. The cover of claim 1, wherein the cover comprises a geometry selected from the group consisting of: torus, a substantially spherical shape, and a substantially oblong shape.

6. The cover of claim 3 wherein the rigid three-dimensional light source cover comprises a single piece of non-rigid material.

7. The cover of claim 6 wherein the non-rigid material has digitally created and marked score lines to identify locations for said folds.

8. The cover of claim 1, wherein the cover comprises a base and an upper support.

9. A method of making a cover for a light source comprising:

marking score patterns on a flat non-rigid material, wherein the non-rigid material includes a first outer side and a third outer side, wherein said first and third outer sides are spaced a distance apart, are parallel, and are of substantially the same length, a second outer side and a fourth outer side, wherein said second and fourth outer sides are spaced a distance apart, are parallel, and are of substantially the same length, a first group of parallel score lines comprising a plurality of score lines which traverse the material between the second outer side and the fourth outer side being parallel and adjacent to the first and third outer sides, further being equally spaced apart relative to each other and relative to the first and third outer sides, a second group of parallel score lines comprising a plurality of score lines which traverse the material between the first outer side and the third outer side, are parallel to the second outer side and fourth outer side, and are spaced equal distances apart relative to each other and relative to the first and third outer sides, and a third group of score lines comprising a plurality of score lines which traverse the material between the first outer side and the third outer side;

folding said non-rigid material with mountain and valley folds according to the score patterns into a rigid three-dimensional shape;

attaching said three-dimensional shape to a base such that said three-dimensional shape is rigid in an X-Y plane and vertically flexible in a Z-direction; and attaching said three dimensional shape to a light source.

10. The method of claim 9, further comprising inserting a plurality of openings onto the non-rigid material, the plurality of openings to receive a string or a cord; and hanging said three-dimensional shape from a ceiling using the string or the cord in combination with the plurality of openings.

11. The method of claim 9, wherein the rigid three-dimensional shape comprises a single piece of non-rigid material.

12. The method of claim 9, wherein the non-rigid material is selected from the group consisting of paper, cardboard, synthetic material, and cotton paper.

13. The method of claim 9, wherein marking includes executing one or more digital computer programs to generate and mark the score patterns, and wherein the non-rigid material provides an expanded and compressed three-dimensional shape.

14. The method of claim 9, wherein the light source is comprised of light-emitting diode (LED) lights.

15. The method of claim 9 wherein marking includes executing one or more digital computer programs to generate and mark the score patterns.

16. The method of claim 9 wherein the light source is comprised of light-emitting diode (LED) lights.

17. The method of claim 11, further comprising attaching said three dimensional shape to an upper support disposed on top of the cover, the upper support configured to further support said three-dimensional shape in the Z-direction.

18. An apparatus for forming a three-dimensional structure comprising:

a single, flat piece of non-rigid material including a first outer side and a third outer side, wherein said first and third outer sides are spaced a distance apart, are parallel, and are of substantially the same length, a second outer side and a fourth outer side, wherein said second and fourth outer sides are spaced a distance apart, are parallel, and are of substantially the same length, a first group of parallel score lines comprising a plurality of score lines which traverse the material between the second outer side and the fourth outer side being parallel and adjacent to the first and third outer sides, further being equally spaced apart relative to each other and relative to the first and third outer sides, a second group of parallel score lines comprising a plurality of score lines which traverse the material between the first outer side and the third outer side, are parallel to the second outer side and fourth outer side, and are spaced equal distances apart relative to each other and relative to the first and third outer sides, and a third group of score lines comprising a plurality of score lines which traverse the material between the first outer side and the third outer side, each score line comprising:

a plurality of segments wherein a first segment begins at the first outer side, said plurality of segments proceeding at alternating angles of about 45° to every score line of the first group of score lines, and a last segment terminating at the third outer side.

19. An apparatus for forming a three-dimensional structure comprising:

a single, flat piece of non-rigid material including:

a first outer side and a third outer side, wherein said first and third outer sides are spaced a distance apart, are parallel, and are of substantially the same length;

a second outer side and a fourth outer side, wherein said second and fourth outer sides are spaced a distance apart, are parallel, and are of substantially the same length;

a first group of three parallel score lines which traverse the single flat piece of material from the second outer side to the fourth outer side being parallel and adjacent to the first outer side;

a second group of three parallel score lines which traverse the single flat piece of material from the second outer side to the fourth outer side being parallel and adjacent to the first group of three parallel score lines;

a third group of three parallel score lines which traverse the single flat piece of material from the second outer side to the fourth outer side being parallel and adjacent to the second group of three parallel score lines;

a fourth group of three parallel score lines which traverse the single flat piece of material from the second outer side to the fourth outer side being parallel and adjacent to the third group of three parallel score lines and the third outer side;

a fifth group of parallel score lines comprising a plurality of score lines which traverse the single flat piece of material from the first outer side to the third outer side, are parallel to the second outer side and fourth outer side, and are spaced equal distances apart relative to each other; and a sixth group of score lines comprising a plurality of score lines which traverse the single flat piece of material from the first outer side to the third outer side, each score line comprising:

a first segment proceeding from the first outer side to a first line of the first group of three parallel score lines at a substantially 45° angle to the first outer side;

a second segment proceeding from the first line of the first group of three parallel score lines to a second line of the first group of three parallel score lines at a substantially 45° angle such that the first segment and second segment form a substantially 90° angle;

a third segment proceeding from the second line of the first group of three parallel score lines to a third line of the first group of three parallel score lines at a substantially 45° angle such that the third segment and second segment form a substantially 90° angle;

a fourth segment proceeding from the third line of the first group of three parallel score lines to a first line of the second group of three parallel score lines at a substantially 45° angle such that the fourth segment and third segment form a substantially 90° angle;

a fifth segment proceeding from the first line of the second group of three parallel score lines to a second line of the second group of three parallel score lines at a substantially 45° angle such that the fifth segment and fourth segment form a substantially 90° angle;

a sixth segment proceeding from the second line of the second group of three parallel score lines to a third line of the second group of three parallel score lines at a substantially 45° angle such that the sixth segment and fifth segment form a substantially 90° angle;

a seventh segment proceeding from the third line of the second group of three parallel score lines to a first line of the third group of three parallel score lines at a substantially 45° angle such that the seventh segment and sixth segment form a substantially 90° angle;

an eighth segment proceeding from the first line of the third group of three parallel score lines to a second line of the third group of three parallel score lines at a substantially 45° angle such that the eighth segment and seventh segment form a substantially 90° angle;

a ninth segment proceeding from the second line of the third group of three parallel score lines to a third line of the third group of three parallel score lines at a substantially 45° angle such that the ninth segment and eighth segment form a substantially 90° angle;

a tenth segment proceeding from the third line of the third group of three parallel score lines to a first line of the fourth group of three parallel score lines at a substantially 45° angle such that the tenth segment and ninth segment form a substantially 90° angle;

an eleventh segment proceeding from the first line of the fourth group of three parallel score lines to a second line of the fourth group of three parallel score lines at a substantially 45° angle such that the eleventh segment and tenth segment form a substantially 90° angle;

a twelfth segment proceeding from the second line of the fourth group of three parallel score lines to a third line of the fourth group of three parallel score lines at a substantially 45° angle such that the twelfth segment and eleventh segment form a substantially 90° angle; and a thirteenth segment proceeding from the third line of the fourth group of three parallel score lines to the third outer side at a substantially 45° angle such that the thirteenth segment and twelfth segment form a substantially 90° angle.

* * * * *